US006641105B1

(12) United States Patent
Hamerski

(10) Patent No.: US 6,641,105 B1
(45) Date of Patent: Nov. 4, 2003

(54) HANGER

(75) Inventor: Michael D. Hamerski, Township Baldwin, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/706,998

(22) Filed: Nov. 6, 2000

(51) Int. Cl.[7] ..... A47B 97/04

(52) U.S. Cl. ..... 248/452; 248/216.1; 248/205.3

(58) Field of Search ..... 248/452, 467, 248/205.3, 216.1, 217.4, 218.3, 683, 684; 24/370, 552

(56) References Cited

U.S. PATENT DOCUMENTS

| | | | | | |
|---|---|---|---|---|---|
| 71,635 | A | * | 12/1867 | Parsons | 221/141 |
| 547,335 | A | * | 10/1895 | Crocker | 402/68 |
| 684,145 | A | * | 10/1901 | Watt | 402/14 |
| 805,393 | A | * | 11/1905 | Washburn | 402/25 |
| 958,801 | A | * | 5/1910 | Gibbs | 402/25 |
| 1,687,581 | A | * | 10/1928 | Murphy | 211/113 |
| 2,866,583 | A | * | 12/1958 | Batts | 223/88 |
| 3,430,301 | A | * | 3/1969 | Venus | 24/370 |
| 3,633,253 | A | * | 1/1972 | Ellis | 24/552 |
| 3,637,181 | A | * | 1/1972 | Janssen | 248/205.3 |
| 3,910,539 | A | | 10/1975 | Cutler | |
| 4,040,149 | A | * | 8/1977 | Einhorn | 248/493 |
| 4,101,104 | A | | 7/1978 | Minard | |
| 4,244,085 | A | * | 1/1981 | Tsao-Tsung | 24/67.9 |
| 4,338,151 | A | * | 7/1982 | Hutter, III | 156/344 |
| D271,546 | S | | 11/1983 | Smith | |
| D294,113 | S | | 2/1988 | Smyth, III | |
| 4,842,912 | A | * | 6/1989 | Hutter, III | 428/65 |
| 4,863,127 | A | * | 9/1989 | Handler | 248/205.2 |
| 5,096,149 | A | | 3/1992 | Riese | |
| 5,125,758 | A | * | 6/1992 | DeWan | 402/25 |
| 5,129,297 | A | * | 7/1992 | Bussi | 30/366 |
| 5,169,116 | A | * | 12/1992 | Bergetz | 248/680 |
| 5,236,168 | A | * | 8/1993 | Roy | 248/546 |
| D346,736 | S | | 5/1994 | Rosenthal | |
| 5,409,189 | A | * | 4/1995 | Luhmann | 248/205.3 |
| 5,433,413 | A | * | 7/1995 | Adams | 248/205.3 |
| 5,454,542 | A | | 10/1995 | Hart | |
| 5,558,307 | A | * | 9/1996 | Klein et al. | 248/309.1 |
| 5,593,120 | A | * | 1/1997 | Hamerski | 248/205.3 |
| 5,690,561 | A | * | 11/1997 | Rowland et al. | 473/330 |
| 5,921,518 | A | | 7/1999 | Bernardi | |
| 6,095,465 | A | * | 8/2000 | Weck et al. | 248/205.3 |
| 6,106,937 | A | * | 8/2000 | Hamerski | 428/343 |
| 6,162,534 | A | * | 12/2000 | Hamerski | 428/354 |
| 6,186,466 | B1 | * | 2/2001 | Baird et al. | 248/475.1 |
| 6,206,334 | B1 | * | 3/2001 | Weck et al. | 248/467 |
| 2003/0047654 | A1 | * | 3/2003 | Johansson et al. | 248/205.3 |

FOREIGN PATENT DOCUMENTS

| | | | |
|---|---|---|---|
| BE | 1 004 989 | A | 3/1993 |
| CH | 247 664 | A | 3/1947 |
| EP | 0 878 155 | A | 11/1998 |
| JP | 10 085495 | A | 4/1998 |

* cited by examiner

*Primary Examiner*—Kimberly Wood
*Assistant Examiner*—Naschica S. Morrison
(74) *Attorney, Agent, or Firm*—William L. Huebach

(57) ABSTRACT

A hanger comprising a base having a supported surface adapted to be positioned along a generally vertical surface, and an elongate peg having one end mounted on the base with a portion of the peg projecting from an outer surface of the base opposite its supported surface generally at a right angle with respect to the supported surface of the base. The peg has an axially extending surface portion adapted to be positioned uppermost when the supported surface of the base is positioned along a generally vertical surface, which axially extending surface portion restricts free movement axially of the peg of sheets of paper around and hanging on the peg. That axially extending surface portion can be defined by a layer of adhesive on the peg or by closely spaced sharp edges on the peg. Such sharp edges could be on screw threads around the peg, ridges extending transversely across the peg, serrations formed on the peg, or by abrasive granules adhered along the peg.

2 Claims, 3 Drawing Sheets

HANGER

FIELD OF THE INVENTION

The present invention relates to hangers of the type including a base having a supported surface adapted to be positioned along a generally vertical surface, and a projection from an opposite outer surface of the base on which objects such as a calendar or a poster can be hung.

BACKGROUND

The art is replete with hangers of the type including a base having a supported surface adapted to be positioned and attached along a generally vertical surface, and a projection from an opposite outer surface of the base on which objects such as a calendar or a poster can be hung. Typically the projection on such a hanger is curved and projects generally upwardly, and while it provides good support for such objects, an object must be manipulated through a variety of different positions to cause it to pass along the length of the projection to a position adjacent the base of the hanger at which the object is supported on the projection. This is not particularly troublesome when all of the sheets of a multi-sheet object, such as a calendar, to be supported on the hanger are moved together over the hanger's projection. It can be more troublesome, however, when that multi sheet object or calendar is already supported on the hanger, and it is desired to move only one or less than all of the sheets of the object or calendar onto or off of the projection (e.g., when the sheet for a new month is to be displayed, or when it is desired to look at month following or preceding the month currently being displayed). The entire multi-sheet object or calendar may be lifted by a single sheet moving onto or off of the projection, and if care is not taken, the weight of the calendar can tear a single sheet being moved along the projection so that it can no longer be retained on the projection.

DISCLOSURE OF THE INVENTION

The present invention provides a hanger that can easily receive and support a multi-sheet object, such as a calendar, and affords easy movement of only one or less than all of the sheets of the object or calendar onto or off of the hanger with little risk of tearing that sheet or sheets.

The hanger according to the present invention comprises a base having a supported surface adapted to be positioned along a generally vertical surface, and an elongate projection or peg having a longitudinal axis and first and second longitudinally spaced ends. A portion of the peg adjacent its first end is mounted on the base with the axis of the peg generally at a right angle with respect to the supported surface of the base, and a portion of the peg adjacent its second end projects from an outer surface of the base opposite its supported surface. The peg has an axially extending surface portion adapted to be positioned uppermost when the supported surface of the base is positioned along a generally vertical surface, which axially extending surface portion of the peg restricts free movement of sheets of paper around the peg axially of the peg. That axially extending surface portion can be defined by a layer of adhesive on the peg or by closely spaced sharp edges on the peg. Such sharp edges could be sharp edges on screw threads extending around the peg or ridges extending across the peg, or sharp edges on projections formed on the peg by knurling or otherwise causing serrations on the peg, or by coating the peg with abrasive granules.

Preferably the peg has a small diameter (e.g., less than about 0.17 inch or 0.43 centimeter, and preferably about 0.11 inch or 0.28 centimeter) compared to the diameter of the openings typically punched in a calendar or other documents to receive a hanger, and the peg projects from the outer surface of the hanger by a short distance (e.g., in the range of about 0.15 to 0.30 inch or 0.38 to 0.76 centimeter) so that the calendar can easily be positioned around the peg, and one sheet or less than all of the sheets of the calendar can be easily be moved onto or off of the short horizontally extending peg without risk of tearing the sheet or sheets being moved. When the sheets are supported on the peg, however, the sharp edges or adhesive along the upper surface of the peg will effectively retain the sheets around the peg.

While the hanger according to the present invention is particularly useful for hanging multi-sheet documents which have aligned preformed openings in the sheets for receiving the peg of the hanger, it is also quite useful for hanging one or more sheets which have no such preformed openings. Such sheets (e.g., letters, memos, bills, restaurant order sheets, etc.) can be pressed over the outer or second end of the peg (which second end can be pointed to facilitate such pressing), whereupon, the sharp edges or adhesive along the axially extending surface portion of the peg will effectively retain the sheets around the peg until they are manually removed.

While the peg can be mounted in a fixed use location on the backing of the hanger, it may also be desirable to mount the peg on the backing of the hanger so that it can be moved between a storage position with the peg extending along the outer surface of said base, to the use position described above with the axis of said peg generally at a right angle with respect to the supported surface of the base. Such a storage position for the peg can facilitate supplying and packaging the hanger with thin objects such as calendars.

The base can be attached along a vertical surface by any means including mechanical fasteners such as screws or nails, or a suitable adhesive. One particularly convenient means of attachment is a length of the stretch release adhesive sold by Minnesota Mining and Manufacturing Company, St. Paul, Minn., under that trade designation "Command". The stretch release adhesive sold by Beiersdorf AG, Hamburg, Germany, under that trade designation "Power Strips" could also be used.

BRIEF DESCRIPTION OF THE DRAWING

The present invention will be further described with reference to the accompanying drawing wherein, like parts are identified with like reference numerals in the several views, and wherein.

DETAILED DESCRIPTION OF THE INVENTION

Figure 1:
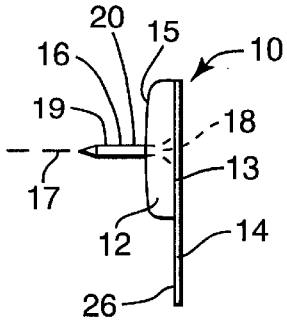
FIG. 1 is a side view of a first embodiment of a hanger according to the present invention.
Figure 2:
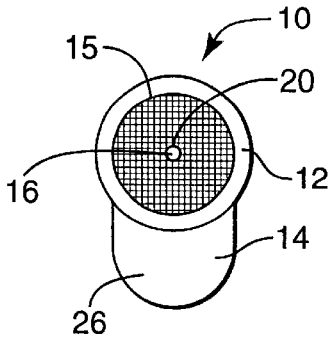
FIG. 2 is a front view of the hanger of FIG. 1.
Figure 3:
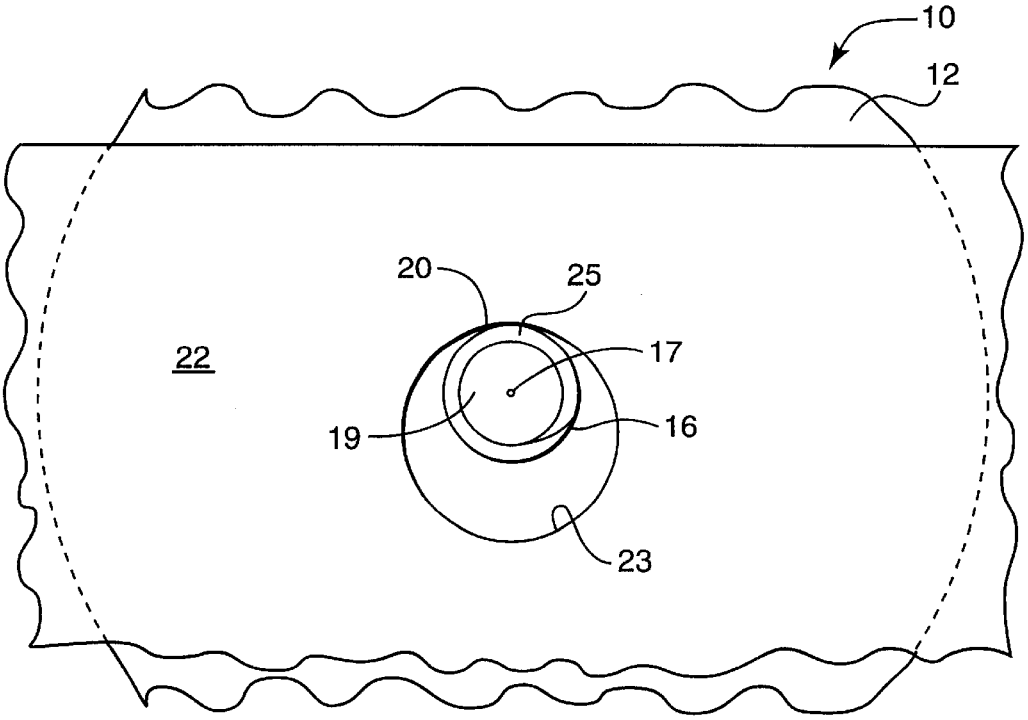
FIG. 3 is an enlarged fragmentary front view of the hanger of FIG. 1 that illustrates a sheet hung on a peg included in the hanger.

Referring now to FIGS. 1, 2, and 3 of the drawing there is illustrated a first embodiment of a hanger according to the present invention generally designated by the if reference numeral 10. Generally, the hanger 10 comprises a base 12 having a supported surface 13 adapted to be positioned along a generally vertical surface and adhered to that vertical surface by a length 14 of stretch release adhesive described below. The hanger 10 also includes an elongate projection or peg 16 having a longitudinal axis 17 and first and second longitudinally spaced ends 18 and 19. A portion of the peg 16 adjacent its first end 18 is mounted on the base 12 with the axis 17 of the peg 16 generally at a right angle with respect to the supported surface 13 of the base, and a portion of the peg 16 adjacent its second end 19 projecting from an outer surface 15 of the base 12 opposite its supported surface 13. The peg 16 has a surface portion 20 extending axially from the outer surface 15 of the base to its second end 19 that is defined by closely spaced sharp edges (i.e., screw threads or ridges around the peg 16), which surface portion 20 is adapted to be positioned uppermost when the supported surface 13 of the base 12 is positioned along a generally vertical surface. Those sharp edges on the screw threads along that surface portion 20 will restrict movement axially of the peg 16 of sheets of paper that are positioned around and hung on the peg 16.

As an example, the peg 16 can be formed by a No. 4-40 or 4-48 metal or polymeric screw threaded through the base 12, which base 12 is made of a metal or a polymeric material. The peg or screw 16 can project in the range of about 0.15 to 0.30 inch or 0.38 to 0.76 centimeter (e.g., about 0.2 inch or 0.5) from the outer surface 15 of the base 12. That peg or screw 16 has a sufficiently small diameter (i.e., about 0.11 inch or 0.28 cm) to be easily received in openings of the type typically pre-formed in calendars which have been found to have diameters of from about 0.12 inch or 0.3 cm to about 0.25 inch or 0.64 cm, with the majority being generally in the range of 0.17 inch or 0.43 cm to 0.19 inch or 0.48 cm. As can be seen in FIG. 3, a sheet 22 having a circular opening 23 in that range with a diameter of about 0.17 inch or 0.43 cm can easily be positioned around the peg 16 when it is formed by a No. 4-40 or 4-48 screw, and that one sheet 22 or less than all of the sheets of the calendar can easily be moved onto or off of the short horizontally extending peg 16 without risk of tearing the sheet 22 or sheets being moved. When the sheet 22 or sheets are positioned around and hung on the peg 16, however, the sharp edges on the threads or ridges 25 along the upper surface portion 20 of the peg 16 will effectively retain the sheet 22 or sheets against axial movement along the peg 16.

While the hanger 10 is useful for hanging multi-sheet documents which have aligned preformed openings in the sheets (such as the opening 23 in the sheet 22) for receiving the peg 16 that are larger than the peg 16, the hanger 10 is also quite useful for hanging one or more sheets which have no such preformed openings, or have preformed openings that are smaller than the peg 16. Such sheets (e.g., letters, memos, bills, restaurant order sheets, etc.) can be pressed over the outer or second end 19 of the peg 16, and, as illustrated, that second end 19 can be generally pointed to facilitate pressing the sheet over it, whereupon, the sharp edges on the ridges or threads along the axially extending surface portion 20 of the peg 16 will effectively retain the sheet around and hung on the peg 16 until it is manually removed.

The length 14 of stretch release adhesive for adhering the supported surface 13 of the base 12 along a generally vertical surface can be a length of the stretch release adhesive sold by Minnesota Mining and Manufacturing Company, St. Paul, Minn., under that trade designation "Command". The stretch release adhesive sold by Beiersdorf AG, Hamburg, Germany, under that trade designation "Power Strips" could also be used. One surface of the length 14 of stretch release adhesive is adhered to the supported surface 13. To attach the base 12 to a vertical surface using that length of stretch release adhesive 14, a release liner is removed from its side opposite the base 12, and the exposed surface of the adhesive 14 is adhered to the vertical surface. Should it be desired to remove the hanger 10 from that vertical surface at some later time, a tab portion 26 of the length of adhesive 14 that projects past one edge of the base 12 is manually grasped and pulled away from the base 12 along the vertical surface to stretch and elongate the length of adhesive 14, causing it to release its adhesive attachment to the vertical surface and to the supported surface 13 of the base 12. As an alternative to the length of stretch release adhesive 14, the supported surface 13 of the base 12 can be attached to a vertical surface by any other suitable means such as mechanical fasteners (e.g., screws or nails), or a suitable non-stretch release adhesive.

Figure 4:
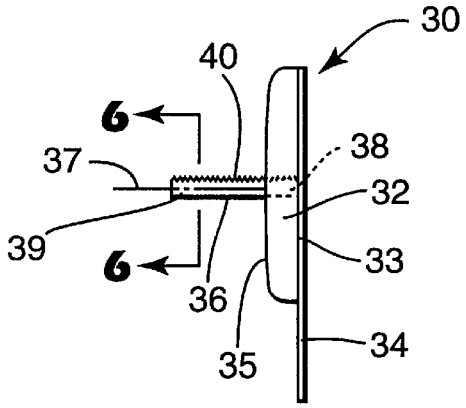
FIG. 4 is a side view of a second embodiment of a hanger according to the present invention.
Figure 5:
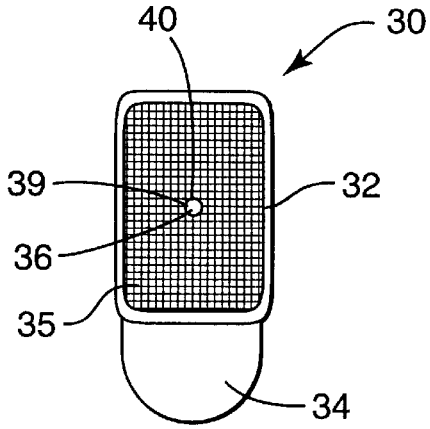
FIG. 5 is a front view of the hanger of FIG. 4.
Figure 6:
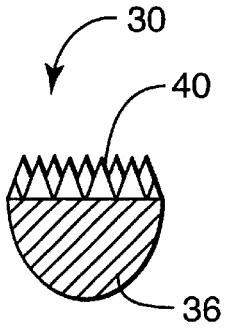
FIG. 6 is an enlarged cross sectional view taken approximately along line 6—6 of FIG. 4.

Referring now to FIGS. 4, 5, and 6 of the drawing there is illustrated a second embodiment of a hanger according to the present invention generally designated by the reference numeral 30. Generally, the hanger 30 comprises a base 32 having a supported surface 33 adapted to be positioned along a generally vertical surface and adhered to that vertical surface by a length 34 of the same stretch release adhesive described above. The hanger 30 also includes an elongate projection or peg 36 having a longitudinal axis 37 and first and second longitudinally spaced ends 38 and 39. A portion of the peg 36 adjacent its first end 38 is mounted on the base 32 with the axis 37 of the peg 36 generally at a right angle with respect to the supported surface 33 of the base, and a portion of the peg 36 adjacent its second end 39 projecting from an outer surface 35 of the base 32 opposite its supported surface 33. The peg 36 has a surface portion 40 extending axially from the outer surface 35 of the base to its second end 39 that is defined by closely spaced sharp edges (i.e., the top of the peg 36 is serrated or knurled to form peaks having the edges along the surface portion 40), which surface portion 40 is adapted to be positioned uppermost when the supported surface 33 of the base 32 is positioned along a generally vertical surface. The edges on those sharp peaks along that surface portion 40 will restrict sheets of paper positioned around and hanging on the peg 36 from moving axially of the peg 36.

As an example, the peg 36 can be a formed of metal or a polymeric material that is serrated or knurled along the surface portion 40 to provide about 60 to 100 peaks per lineal inch or about 23 to 40 peaks per linear cm longitudinally along the peg 36, and the peg 36 can project in the range of about 0.15 to 0.30 inch or 0.38 to 0.76 centimeter (e.g., about 0.2 inch or 0.5) from the outer surface 35 of the base 32. That peg 36 should have a sufficiently small diameter (e.g., less than about 0.17 inch or 0.43 centimeter, and preferably about 0.11 inch or 0.28 centimeter) to be easily received in openings of the type typically formed in calendars.

Like the hanger 10, the hanger 30 is useful for hanging multi-sheet documents which have aligned preformed openings in the sheets for receiving the peg 36 that are larger than the peg 36, and can also be useful for hanging one or more sheets which have no such preformed openings, or have preformed openings that are smaller than the peg 36. Such sheets can be pressed over the outer or second end 39 of the peg 36, which could be flat as illustrated or could alternatively be made generally pointed to facilitate pressing the sheet over it, whereupon, the sharp edges on the peaks along the axially extending surface portion 40 of the peg 36 will effectively retain the sheet around and hanging on the peg 36 until it is manually removed.

Figure 7:
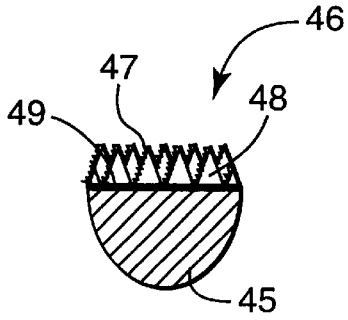
FIG. 7 is a cross sectional view of a peg included in a third embodiment of a hanger according to the present invention.

Referring now to FIG. 7 of the drawing there is illustrated a sectional view of a peg 45 included in a third embodiment of a hanger according to the present invention generally designated by the reference numeral 46. The hanger 46 includes a base and a length of stretch release adhesive adhered to a supported surface of the base that are not shown but have essentially the same structures as the base 32 and the length 34 of stretch release adhesive of the hanger 30. The hanger 46 differs from the hanger 30 only by the structure of peaks that provide sharp edges along a surface portion 47 of the peg 45 that projects from the base of the hanger 46 with its axis at a right angle to the supported surface of the base, and on which surface portion 47 a sheet of material can be supported or hung when the base of the hanger 46 is adhered to a vertical surface with the surface portion 47 uppermost. Instead of being formed by serrating or knurling, the peaks on the peg 45 of the hanger 46 are provided by a coating of abrasive granules 48 (e.g., about 120 grit) adhered along a surface 49 of the peg 45.

Figure 8:
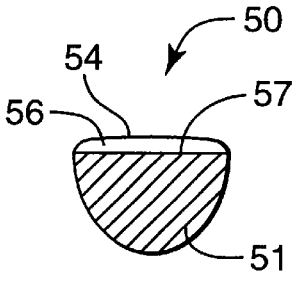
FIG. 8 is a cross sectional view of a peg included in a fourth embodiment of a hanger according to the present invention.

Referring now to FIG. 8 of the drawing there is illustrated a sectional view of a peg 51 included in a fourth embodiment of a hanger according to the present invention generally designated by the reference numeral 50. The hanger 50 includes a base and a length of stretch release adhesive adhered to a supported surface of the base that are not shown but have essentially the same structures as the base 32 and the length 34 of stretch release adhesive of the hanger 30. The peg 51 projects from the base of the hanger 50 with its axis at a right angle to the supported surface of the base. The hanger 50 differs from the hanger 30 only by the structure of the peg 51 that defines a surface portion 54 of the peg 51 on which a sheet of material can be supported or hung when the base of the hanger 50 is adhered to a vertical surface with the surface portion 54 uppermost. Instead of having peaks or serrations formed by knurling or other means, or peaks formed by abrasive granules, the peg 51 of the hanger 50 has a coating 56 of adhesive along a surface 57 of the peg 51 that defines that surface portion 54. The adhesive defining the surface portion 54 provides frictional and light adhesive engagement with edges of sheets of paper positioned around and hung on the peg 51 to restrict those sheets from moving axially of the peg 51. As a non-limiting example, a suitable adhesive would be the firm pressure sensitive adhesive from the clear adhesive transfer tape sold by Minnesota Mining and Manufacturing Company, St. Paul, Minn., under the trade designation "VHB adhesive tape No. F-9473TC".

Figure 9:
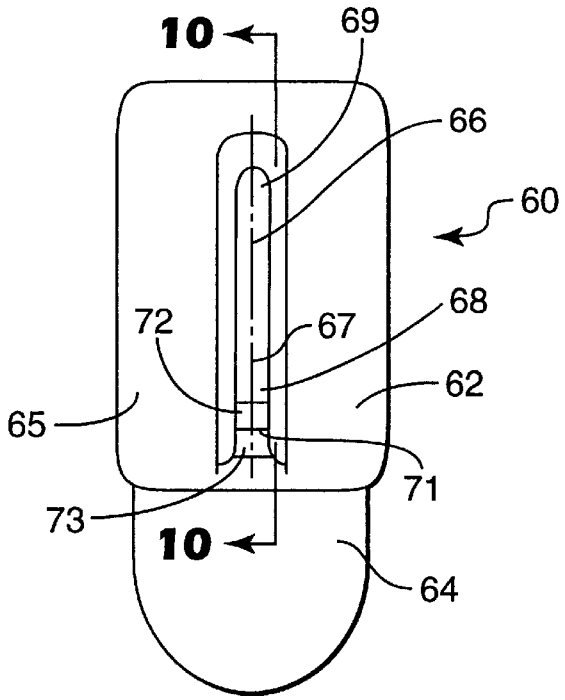
FIG. 9 is a front view of a fifth embodiment of a hanger according to the present invention with a peg included in the hanger positioned in a storage position.
Figure 10:
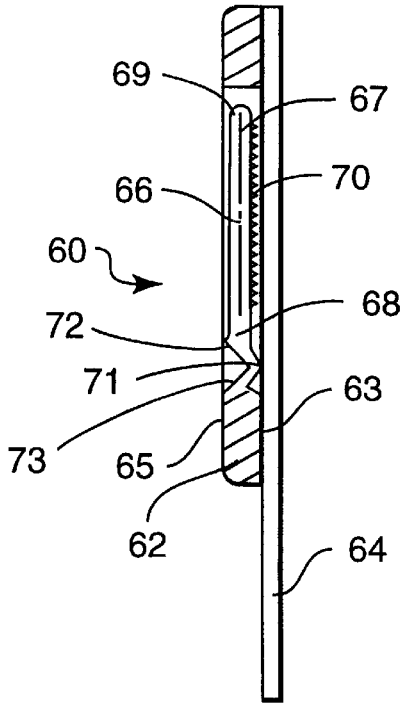
FIG. 10 is an enlarged cross sectional view taken approximately along line 10—10 of FIG. 9.
Figure 11:
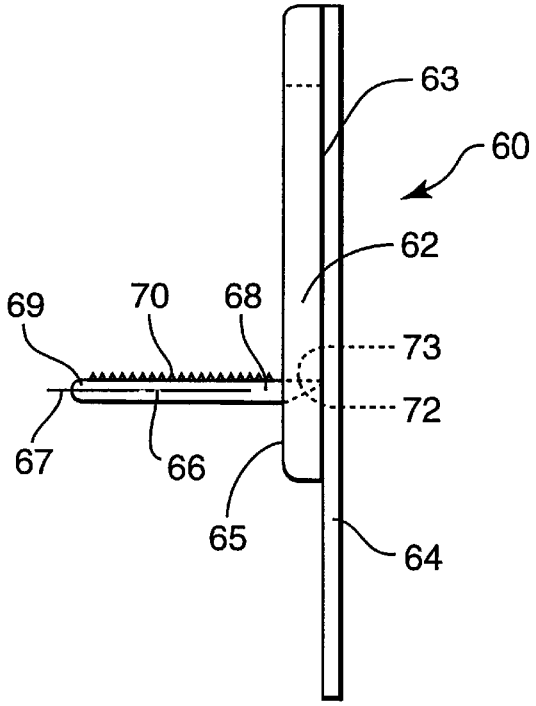
FIG. 11 is a side view of the hanger of FIG. 9 with a peg included in the hanger positioned in a use position.

Referring now to FIGS. 9, 10, and 11 of the drawing there is illustrated a fifth embodiment of a hanger according to the present invention generally designated by the reference numeral 60. Generally, the hanger 60 comprises a base 62 having a supported surface 63 adapted to be positioned along a generally vertical surface and adhered to that vertical surface by a length 64 of same stretch release adhesive described above. The hanger 60 also includes an elongate projection or peg 66 having a longitudinal axis 67 and first and second longitudinally spaced ends 68 and 69. A portion of the peg 66 adjacent its first end 68 is mounted on the base 62 to afford movement of the peg 66 between (1) a use position (FIG. 11) with the axis 67 of the peg 66 generally at a right angle with respect to the supported surface 63 of the base 62, and a portion of the peg 66 adjacent its second end 69 projecting from an outer surface 65 of the base 62 opposite its supported surface 63; and (2) a storage position (FIGS. 9 and 10) with the peg 66 extending along a groove defined by the outer surface 65 of the base 62. The peg 66 has a surface portion 70 extending (when the peg 66 is in its use position shown in FIG. 11) axially from the outer surface 65 of the base 62 to its second end 69. That surface portion 70 is defined by closely spaced transversely extending ridges having sharp distal edges and is adapted to be positioned uppermost when the supported surface 63 of the base 62 is positioned along a generally vertical surface. Those sharp edges defining that surface portion 70 will restrict movement axially of the peg of sheets of paper positioned around and hung on the peg 66.

The base 62 and the peg 66 including the transverse ridges that define the surface portion 70 can be integrally molded of a polymeric material (e.g., nylon, polystyrene, or polycarbonate) with the peg 66 in its storage position and with the molding including a thin bendable section 71 (sometimes called a "living hinge") between the base 62 and the first end 68 of the peg 66 The peg 66 can be moved to its use position by bending the thin bendable section 71 until a surface 72 on the peg 66 contacts a surface 73 on the base to define that use position.

The storage position for the peg 66 (FIGS. 9 and 10) can facilitate supplying and packaging the hanger 60 with thin objects such as calendars because in the storage position the peg 66 does not project above the outer surface 65 of the base 62.

The surface portion 70 can be defined by about 40 ridges per inch or about 15.8 ridges per cm longitudinally along the peg 66, and the peg 66 can project in the range of about 0.15 to 0.30 inch or 0.38 to 0.76 centimeter (e.g., about 0.2 inch or 0.5 cm) from the outer surface 65 of the base 62. That peg 66 can have a sufficiently small diameter (e.g., less than about 0.17 inch or 0.43 cm diameter and preferably about 0.11 inch or 0.28 cm diameter) to be easily received in openings of the type formed in most calendars. Like the hanger 10, the hanger 60 is useful for hanging multi-sheet documents which have aligned preformed openings in the sheets for receiving the peg 66 that are larger than the peg 66, and can also be useful for hanging one or more sheets which have no such preformed openings, or have preformed openings that are smaller than the peg 66. Such sheets can be pressed over the outer or second end 69 of the peg 66, which could be rounded as illustrated or could alternatively be made more pointed to facilitate pressing the sheet over it, whereupon, the sharp edges on the ridges spaced along the axially extending surface portion 70 of the peg 66 will effectively retain the sheet hung around the peg 66 until it is manually removed.

The present invention has now been described with reference to several embodiments and modifications thereof. It will be apparent to those skilled in the art that many changes can be made in the embodiments described without departing from the scope of the present invention. For example, hangers generally of the type described above could provide advantages for hanging items other than calendars or other multi-sheet objects. For example, cards to which sales items are attached by plastic "blister packs" or otherwise could be hung from such hangers at commercial displays. Such hangers used for that purpose could have pegs that are longer (e.g., 2 to 6 inches or 5 to 15 centimeters long) and of larger diameter (e.g., 0.15 to 0.2 inch (0.38 to 0.5 cm) or larger) than the pegs described above to accommodate a commercially suitable number of cards. Also, hangers generally of the type described above could be useful for hanging other items, such as tools (e.g., brooms or gardening tools) that have through openings in wooden handles for receiving a peg on which they can be hung, the pegs on such hangers also being longer and of larger diameter than those described above for use on calendars or other multi-sheet objects. Thus, the scope of the present invention should not be limited to the structures described in this application, but only by the structures described by the language of the claims and the equivalents thereof.

What is claimed is:

1. A paper hanger for one or more sheets of paper, said hanger comprising:

a base having a supported surface adapted to be positioned along a generally vertical surface, and an opposite outer surface; and an elongate peg having a longitudinal axis and first and second longitudinally spaced ends, a major portion of said peg adjacent said second end having a diameter of less than about 0.17 inch (0.43 centimeter), having a generally uniform cross sectional area along its length, and having an axially extending surface portion defining closely spaced sharp edges, a portion of said peg adjacent said first end being mounted on said base for movement of said peg between a storage position with said peg extending along the outer surface of said base, and a use position with the axis of said peg generally at a right angle with respect to said supported surface and said portion of said peg adjacent said second end projecting from said outer surface so that said sharp edges can be positioned uppermost when said supported surface is positioned along a generally vertical surface to restrict movement of sheets of paper around said peg axially of said peg;

said base and said peg being a unitary molding of polymeric material, said outer surface of said base including an outer portion and a recessed portion defining a groove recessed from said outer portion, said peg being in said groove in said storage position of said peg, and said unitary molding being bendable between said base and said peg to afford movement of said peg between said storage and use positions.

2. A paper hanger according to claim 1 wherein said sharp edges are defined by transverse ridges axially spaced along said peg.

* * * * *